US009518552B2

(12) United States Patent
Daeschner et al.

(10) Patent No.: US 9,518,552 B2
(45) Date of Patent: Dec. 13, 2016

(54) IGNITION CIRCUIT

(71) Applicant: Andreas Stihl AG & Co. KG, Waiblingen (DE)

(72) Inventors: Heiko Daeschner, Leutenbach (DE); Arno Kinnen, Fellbach (DE); Ernst Buck, Murrhardt (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 653 days.

(21) Appl. No.: 13/707,131

(22) Filed: Dec. 6, 2012

(65) Prior Publication Data

US 2013/0146040 A1 Jun. 13, 2013

(30) Foreign Application Priority Data

Dec. 7, 2011 (DE) ..... 10 2011 120 462

(51) Int. Cl.

| | |
|---|---|
| ***F02P 1/08*** | (2006.01) |
| ***F02P 3/055*** | (2006.01) |
| *B27B 17/00* | (2006.01) |
| *F02B 63/02* | (2006.01) |
| *F02D 17/04* | (2006.01) |
| *F02D 41/22* | (2006.01) |

(52) U.S. Cl.

CPC ..... *F02P 1/08* (2013.01); *F02P 1/083* (2013.01); *F02P 3/055* (2013.01); *B27B 17/00* (2013.01); *B27B 17/0033* (2013.01); *F02B 63/02* (2013.01); *F02D 17/04* (2013.01); *F02D 41/22* (2013.01); *F02D 2400/06* (2013.01)

(58) Field of Classification Search

CPC .. F02D 2400/04; F02D 2400/06; F02D 41/22; F02B 63/02; F02B 2075/025; F02P 1/02; F02P 1/08; F02P 1/083; F02P 3/055

USPC ..... 123/198 D, 198 DC

See application file for complete search history.

(56) References Cited

U.S. PATENT DOCUMENTS

| | | | | |
|---|---|---|---|---|
| 3,224,473 | A * | 12/1965 | Dobbertin et al. | 30/383 |
| 3,525,373 | A * | 8/1970 | Kobayashi | 30/381 |
| 4,266,515 | A * | 5/1981 | Bross | 123/198 E |
| 4,469,080 | A * | 9/1984 | Brunner et al. | 123/595 |
| 4,697,560 | A * | 10/1987 | Umehara | 123/335 |

(Continued)

FOREIGN PATENT DOCUMENTS

| | | | |
|---|---|---|---|
| CA | 1078915 | A1 | 6/1980 |
| EP | 0 727 578 | A2 | 8/1996 |
| JP | 2005220869 | A * | 8/2005 |

*Primary Examiner* — Mahmoud Gimie
*Assistant Examiner* — John Zaleskas
(74) *Attorney, Agent, or Firm* — Walter Ottesen, P.A.

(57) ABSTRACT

An ignition circuit for a combustion engine has an ignition coil and a control unit for the coil. The coil and the control unit are included in a common component as an ignition module. The module is supplied with voltage by a generator driven by the engine. A spark plug and the coil form a power circuit which includes a line segment to a reference potential outside the module. A sensor detects data of the engine and the output of the sensor is supplied to the module. The sensor is supplied with voltage via a sensor circuit. The sensor circuit and the power circuit use the line segment as a common connection to the reference potential, so that for a defect of the line segment, a missing connection to the reference potential in the high voltage circuit is recognized via the change of the sensor output signals.

16 Claims, 1 Drawing Sheet

(56) References Cited

U.S. PATENT DOCUMENTS

| | | | | |
|---|---|---|---|---|
| 4,709,669 | A * | 12/1987 | Wissmann et al. | 123/149 D |
| 4,712,521 | A | 12/1987 | Campen | |
| 5,910,737 | A * | 6/1999 | Kesler | 327/89 |
| 6,075,366 | A * | 6/2000 | Yasuda | 324/380 |
| 6,247,441 | B1 * | 6/2001 | Sato | F02B 61/045 123/198 D |
| 7,028,676 | B2 | 4/2006 | Regazzi et al. | |
| 2002/0196024 | A1 * | 12/2002 | Peterson et al. | 324/399 |
| 2003/0023367 | A1 * | 1/2003 | Avery et al. | 701/110 |
| 2005/0114087 | A1 * | 5/2005 | Hofmeister | F02D 41/266 702/185 |
| 2006/0102126 | A1 * | 5/2006 | Nakata et al. | 123/179.15 |
| 2007/0028881 | A1 * | 2/2007 | Nakata et al. | 123/179.15 |
| 2007/0034190 | A1 * | 2/2007 | Schieber et al. | 123/406.57 |
| 2008/0041144 | A1 * | 2/2008 | Layher et al. | 73/115 |
| 2008/0041146 | A1 * | 2/2008 | Leufen | 73/116 |
| 2009/0024271 | A1 * | 1/2009 | Inoue | F02D 41/22 701/31.4 |
| 2010/0031918 | A1 * | 2/2010 | Iwata et al. | 123/198 DC |
| 2010/0145595 | A1 * | 6/2010 | Bellistri et al. | 701/103 |
| 2011/0114055 | A1 * | 5/2011 | Naegele et al. | 123/198 DB |
| 2011/0140707 | A1 * | 6/2011 | Boker et al. | 324/511 |

* cited by examiner

IGNITION CIRCUIT

CROSS REFERENCE TO RELATED APPLICATION

This application claims priority of German patent application no. 10 2011 120 462.1, filed Dec. 7, 2011, the entire content of which is incorporated herein by reference.

FIELD OF THE INVENTION

The invention relates to an ignition circuit for a combustion engine, in particular for the combustion engine in a handheld work apparatus.

BACKGROUND OF THE INVENTION

The ignition circuit for two-stroke engines, in particular for two-stroke engines in handheld work apparatus, essentially includes a generator for generating the required ignition energy and an ignition circuit via which an Ignition spark is triggered at a spark plug at predetermined crankshaft angles. The spark plug together with the ignition coil, there the secondary winding of the ignition coil, forms a high voltage circuit which can also be referred to as a power circuit. If the ground connection of the power circuit is electrically interrupted by a defect, high voltage conditions, which can lead to damage to the ignition circuit, can occur.

In order to be able to perform an adaptation of the ignition timing to current operating parameters of the combustion engine, sensors, which, for example, capture and transmit the crankcase pressure or the crankcase temperature to the ignition circuit, are also provided in such ignition circuits.

SUMMARY OF THE INVENTION

It is an object of the invention to configure an ignition circuit for a combustion engine in such a manner that non-specified high voltage conditions are for the most part avoided.

The ignition circuit of the invention is for a combustion engine having a combustion chamber. The ignition circuit includes: a spark plug arranged in the combustion chamber; an ignition coil configured to generate an ignition spark at the spark plug; a control unit configured to control the ignition coil; the control unit and the ignition coil being consolidated in a common component as an ignition module; a generator driven by the combustion engine; the ignition module being connected to the generator; the spark plug being disposed outside of the ignition module; the spark plug and the ignition coil, which is disposed in the ignition module, conjointly forming a power circuit; a reference potential source defining a reference potential outside of the ignition module; the power circuit including a line segment to the reference potential; a sensor configured to detect operating parameters of the combustion engine and to transmit an output signal to the ignition module; a sensor circuit configured to supply a voltage to the sensor; the sensor circuit being connected to the ignition module on the one hand and to the reference potential on the other hand; and, the sensor circuit and the power circuit being configured to use the line segment as a common connection to the reference potential.

A core idea of the invention is the coupling of power circuit and sensor circuit via a common line segment which can be a critical line segment and which is connected to a reference potential. If the line segment is interrupted, for example as a result of mechanical overloading, the power circuit as well as the sensor circuit are interrupted. While the interruption in the power circuit can not be readily determined, the interruption in the sensor circuit leads to an output signal containing errors at the sensor connected to the ignition circuit, for example to a maximum signal corresponding to the value of the supply voltage. This output signal of the sensor containing errors is recognized in the ignition circuit by the control unit and thus the interruption in the power circuit is detected, that is the interruption in the high voltage circuit is recognized. The control unit generates a control signal and will correspondingly take countermeasures, for example, the control unit will switch off the ignition so that undefined high voltage conditions are avoided.

The spark plug is connected to the reference potential via its attachment on the cylinder, wherein the power circuit is closed via the line segment to the reference potential. A voltage connection of the sensor is connected to the reference potential via fixation on the combustion engine; the sensor circuit is closed via the ignition module and the line segment to the reference potential. Thereby, the line segment to the reference potential is preferably formed as a cable, in particular a flexible cable, and bridges a vibration gap between the vibration generating unit of the combustion engine and the unit of the vibration-decoupled ignition module.

In a preferred further embodiment of the invention, at least two sensors powered via the sensor circuit are provided, wherein the control unit evaluates the sensor signals via an evaluation algorithm and intervenes in the ignition in dependence on the evaluation. The control unit can, for example, shut down, when both sensors—because of the loss of the reference potential—output a maximum signal, namely the maximum signal of their voltage supply.

In a further embodiment of the invention, one voltage connection of the sensor is connected to the reference potential via a reverse-biased diode. This diode, preferably configured as a suppressor diode, is off at low voltages, that is in the voltage range of the voltage supply of the sensor arrangement, so that the voltage supply of the sensors is ensured during normal operation.

If undesired high voltage conditions result because of a defect in the power circuit, these high voltages can foe conducted away to the internal ground of the ignition module or the generator via the reference potential and the voltage connection of a sensor as well as a suppressor-diode so that no high voltages can occur at the reference potential. Despite a defect in the line segment, the power circuit is closed in a simple manner.

Advantageously, the suppressor diode is arranged in the ignition module itself, there expediently in the control unit, and thus protects from impermissible high voltage conditions.

The reference potential preferably is the combustion engine, in particular the crankcase of the combustion engine.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
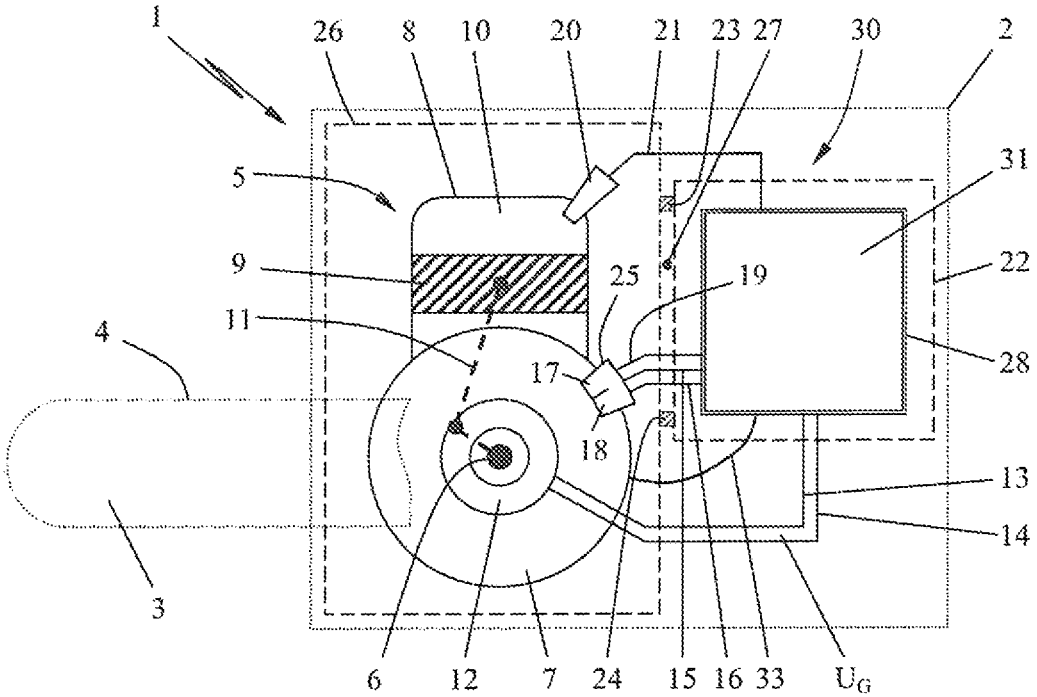
FIG. 1 shows a schematic view of an ignition circuit for a combustion engine in a handheld work apparatus; and, FIG. 2 shows an electrical equivalent circuit of the ignition circuit of FIG. 1.

FIG. 1 shows a schematic illustration of a handheld work apparatus which can be configured for example as a chain saw. The handheld work apparatus can also be a brush cutter, a cut-off machine, a blower or similar work apparatus.

The work apparatus 1 shown schematically in FIG. 1 has a housing 2 on which—in the exemplary case of a chain saw—a guide bar 3 is held on which a saw chain 4 circulates. The saw chain 4 which forms a work tool of the work apparatus 1 is driven by the crankshaft 6 of a combustion engine 5 which primarily includes a crankcase 7 and a cylinder 8. In the cylinder 8 a combustion chamber 10, which has a spark plug 20 associated therewith, is delimited by a piston 9. The piston 9 is connected to the crankshaft 6 via a connecting rod 11; the crankshaft 6 is rotatably driven by the upward and downward movement of the piston 9.

The combustion engine 5 is a two-stroke engine, in particular a one-cylinder two-stroke engine whose ignition is controlled by an ignition circuit 30. When the piston 9 is moving upward, the mixture conveyed into the combustion chamber 10 is ignited prior to the top dead center being reached in order to then rotatably transfer the drive power to the crankshaft 6 and thus the work tool, in the embodiment the saw chain 4, during the downward movement of the piston 9 triggered by the combustion.

The ignition circuit 30 includes an ignition module 31 to which the generator voltage $U_G$ of a generator 12 is supplied. In the embodiment shown, the generator 12 is driven directly by the crankshaft 6 and is connected to the ignition module 31 via both connecting lines (13, 14) (positive pole and negative pole). The ignition module 31 supplies the spark plug 20 with a high voltage far triggering an ignition spark via a high voltage line 21.

A sensor arrangement 25, which includes two sensors 17 and 18, is further connected to the ignition module 31. The one sensor 17 detects the temperature at the location of the sensor 17, that is, the crankcase temperature, and the other sensor 18 detects the pressure in the crankcase 7. The sensors 17 and 18 are fixed on the crankcase 7 and are electrically connected to the combustion engine 5 via their fixation thereon.

Both sensors (17, 18) are supplied with energy via a common voltage connection 19 out of the ignition module 31; the signal lines 15 and 16 of the sensors 17 and 18 lead into the ignition module 31.

In order to set a common reference potential 40 (FIG. 2), the ignition module 31 is connected to the reference potential of the combustion engine 5 via a line segment 33; the line segment 33 preferably is a cable, for example, a flexible cable.

The work apparatus 1 is configured as a vibration decoupled system, that is the unit 22 containing the ignition module 31 is decoupled from the vibration generating unit 26, the combustion engine 5, via anti-vibration elements 23 and 24. The high voltage line 21, the sensor lines, namely the voltage connection 19 and the signal lines 15 and 16, as well as the connecting lines 13 and 14 and the cable forming the line segment 33 are guided over the vibration gap 27 which separates the units 22 and 26 from each other.

Figure 2:
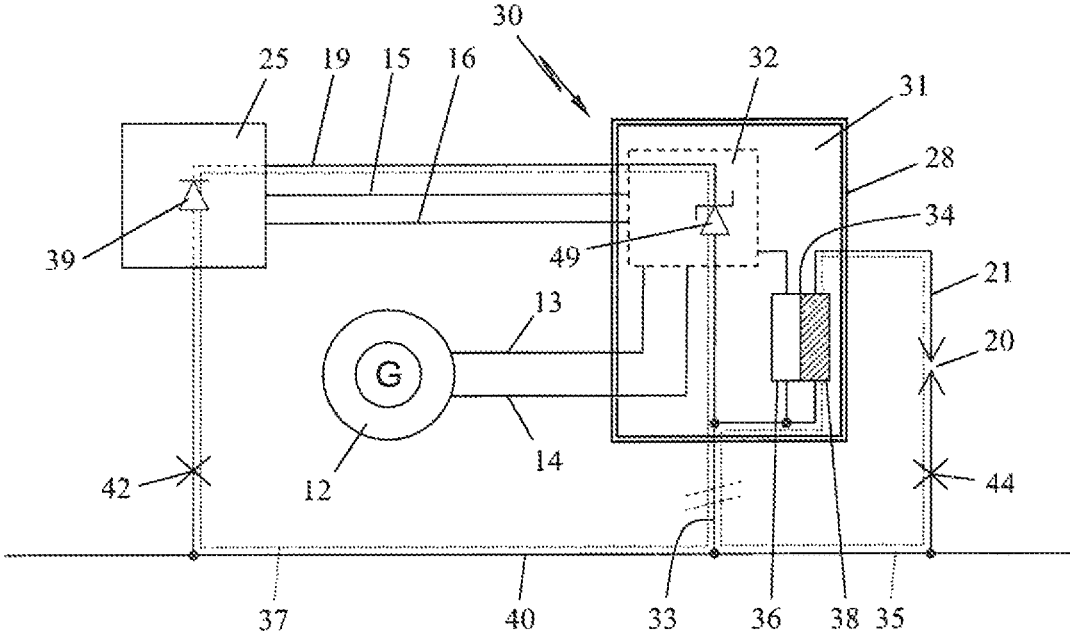

The guiding of the lines according to the invention can foe seen from the electrical equivalent circuit of the ignition circuit according to FIG. 2. The ignition module 31 primarily includes a control unit 32, which executes the control of the ignition based on provided parameters, as well as an ignition coil 34, which in the embodiment consists of a primary winding 36 and a secondary winding 38. The control unit 32 and the ignition coil 34 are located within the ignition module 31 which forms a common component 28. The two connecting lines 13 and 14 of the generator 12 leading into the ignition module 31 lead into the control unit 32 and serve as the entire energy supply of the ignition circuit 30. The generator 12 is preferably configured as an AC generator and outputs a permanent alternating signal—in dependence upon the number of poles and windings used.

The ignition coil 34 together with the spark plug 20 forms a power circuit 35 shown on the right in dotted lines in FIG. 2. According to the example embodiment the power circuit or high-voltage circuit 35 is configured as follows:

The spark plug 20 is threadably engaged in the cylinder 8 of the combustion engine 5 so that it is connected to the combustion engine 5 via its fixation 44 on the cylinder 8. The combustion engine 5, in particular the crankcase 7, forms the reference potential 40 of the ignition circuit 30. The high voltage line 21, which is connected to one end of the secondary winding 38, is connected to the spark plug 20. The other end of the secondary winding 38 is connected to the reference potential 40 via the line segment 33 which, in particular, is configured as a flexible cable. The spark plug 20 which is located outside the ignition module 31 and the ignition coil 34 which is located within the ignition module 31, namely the secondary winding 33 of the ignition coil 34, form the power circuit 35 which is closed via the line segment 33 to the reference potential 40 which is located outside the ignition module 31, because the spark plug 20 is connected to the reference potential 40 via the cylinder 8 of the combustion engine.

The sensor arrangement 25, which includes the two sensors 17 and 18 (FIG. 1), is, on the one hand, connected to the ignition module 31 via the positive voltage connection 19; on the other hand, the signal lines 15 and 16 are connected to the ignition module 31, namely the control unit 32, so that the control unit 32 can evaluate the sensor signals and intervene in the ignition in a manner corresponding to the output signals. The sensors 17 and 18 (FIG. 1) of the sensor arrangement 25 are supplied with voltage via a sensor circuit 37. The sensor circuit 37 is configured as follows:

A sensor (17, 18) is electrically connected to the combustion engine, thus to the reference potential 40, via its fixation 42 on the combustion engine 5, in particular on the crankcase 7. Further, a sensor is, via the voltage connection 19, connected to the ignition module 31, there to the control unit 32 and the positive supply voltage. The sensor circuit 37 is closed via the connection between the control unit 32 and the reference potential 40, wherein this electrical connection includes the line segment 33. It can be advantageous to integrate one or both signal lines (15, 16) of the sensors (17, 18) into the sensor circuit 37; both signal lines are integrated in the sensor circuit so that only one line, the voltage line 19, leads to the Ignition module 31. Hereby, with the omission of a sensor line the corresponding sensor signal is transmitted to the ignition module 31 via the sensor circuit 37, that is the voltage supply, for example by modulating the sensor signal upon the voltage supply.

During operation of the combustion engine, the generator 12 provides the necessary supply voltage UG via its connecting lines 13 and 14. The control unit 32 controls the primary winding 36 of the ignition coil 34 in a crankshaft angle appropriate manner, so that an ignition spark is triggered at the spark plug 20 and the mixture compressed in the combustion chamber 10 is ignited every time shortly before top dead center TDC of the piston 9. The piston 9 is accelerated downward by the combustion pressure and drives the crankshaft 6 via the connecting rod 11. As is typical in two-stroke engines—the flowing out of the combustion gases through an opening outlet and the pushing-in of new combustible mixture into the combustion chamber 10, which is again compressed with the upward stroke of the piston 9 and once again ignited, take place.

The ignition is adapted in dependence upon the crankcase pressure and the crankcase temperature for which the control unit 32 is connected to the sensors 17 and 18.

All lines between the ignition module 31 and the combustion engine 5 run over the vibration gap 27 and are for this reason exposed to a mechanical stress, in particular vibrations.

If an interruption of the high voltage line 21 occurs, the engine can no longer run and stands still. If, as a result of mechanical stress, the connecting lines 13 and 14 fail, the supply voltage is missing and the combustion engines 5 stops.

If the sensors (17, 18) fail, for example as the result of a line interruption, this can be detected by the control unit 32 and the ignition is turned off.

It the line segment 33 breaks and thus the connection to the reference potential, uncontrolled high voltage conditions can arise which could damage the electronics. For this reason according to the embodiment, it is provided that the power circuit 35 and the sensor circuit 37 jointly use the line segment 33 for connecting to the reference potential 40. The line segment 33 is absolutely necessary for the function of ignition and the conducting away of high voltage.

If the line segment 33 breaks, the power circuit 35 is open; at the same time, however, the proper voltage supply of the sensor arrangement 25, that is, the sensors 17 and 18, also fails because the sensor circuit 37 is also interrupted. If the voltage supply of the sensors 17 and 18, however, has no reference potential 40, its output signal increases to a maximum value. This maximum value is determined by the magnitude of the supply voltage whose positive connection remains on the one voltage connection 19 of the sensors (17, 18). If the control unit 32 thus detects a maximum signal on both signal lines 15 and 16, it can—preferably via an algorithm and through evaluation by a microprocessor—be assumed that the line segment 33, that is, the electrical connection of the ignition module 31 to the reference potential 40 is interrupted. The control unit 32 switches off the ignition device; impermissible high voltage conditions cannot occur.

In a further embodiment of the invention, the voltage connection 19 of the sensors (17, 18) is directly connected to the reference potential 40 via a diode 39 provided as a freewheel diode. The diode 39 is reverse-biased so that the supply voltage is blocked relative to the reference potential 40. Accordingly, the supply voltage of the sensor arrangement 25, that is its sensors 17 and 18 (FIG. 1), is ensured. The voltage connection 19 of the sensor arrangement 25 or its sensors 17 and 18 (FIG. 1) is further connected to the internal ground of the ignition module 31, that is to the ground (negative pole) of the generator 12, via a suppressor diode 49 which is reverse-biased. The suppressor diode 49 is integrated in the ignition module 31, there, in particular, in the control unit 32.

Because of a defect in the power circuit 35 undefined high voltage conditions can occur, for example because of a breaking of the line segment 33 which is configured as a flexible cable and which bridges the vibration gap 27 (FIG. 1). According to the invention, in the event of a breaking of the line segment 33, the power circuit 35 remains closed in an economically simple manner via the suppressor diode 49 so that high voltages can discharge. The spark plug 20 is connected to the combustion engine 5, that is to the reference potential 40, to which the sensor or sensor arrangement 25 is also connected. The voltage connection 19 is connected to the reference potential 40 via the reverse-biased freewheel diode 39 and to the internal ground of the ignition module 31, to which the secondary coil 38 is also connected, via the suppressor diode 49. The voltage circuit (power circuit) is closed whereby undefined high voltage conditions in the ignition circuit are avoided; the reference potential 40 can be kept free of high voltage.

It is understood that the foregoing description is that of the preferred embodiments of the invention and that various changes and modifications may be made thereto without departing from the spirit and scope of the invention as defined in the appended claims.

What is claimed is:

1. An ignition circuit for a combustion engine having a combustion chamber, the ignition circuit comprising:

a spark plug arranged in said combustion chamber;

an ignition coil configured to generate a high voltage for triggering an ignition spark at said spark plug;

a control unit configured to control said ignition coil;

said control unit and said ignition coil being consolidated in a common component as an ignition module;

a generator driven by said combustion engine;

said ignition module being connected to said generator;

said spark plug being disposed outside of said ignition module;

said spark plug and said ignition coil, which is disposed in said ignition module, conjointly forming a high-voltage circuit;

a reference potential source defining a reference potential outside of said ignition module;

said high-voltage circuit including a line segment connecting said ignition module to said reference potential;

a sensor configured to detect operating parameters of the combustion engine and to transmit an output signal to said ignition module;

said sensor being electrically connected to said ignition module;

an electric sensor circuit providing a supply voltage to said sensor;

said electric sensor circuit being connected between said ignition module and said reference potential;

said electric sensor circuit being connected via said line segment to said reference potential source;

said high-voltage circuit being connected via said line segment to said reference potential so as to permit both said electric sensor circuit and said high-voltage circuit to be connected via said line segment to said reference potential;

said line segment being a cable;

said combustion engine defining a vibration exciting first unit;

a second unit for accommodating said ignition module therein;

said first and second units being vibration decoupled from each other and conjointly defining a vibration gap therebetween; and, said cable being arranged so as to bridge said vibration gap between said first and second units;

said electric sensor circuit and said high-voltage circuit being interrupted when said line segment is mechanically interrupted;

said output signal of said sensor transmitted to said ignition module being defective when said electric sensor circuit is interrupted; and, said control unit of said ignition module being configured to detect that said output signal is defective and to control said high-voltage circuit to prevent undefined high voltage conditions when said defective output signal is detected.

2. The ignition circuit of claim 1, wherein the combustion engine includes a cylinder, and wherein:

said spark plug is fixed on said cylinder via a fastening and connected to said reference potential via said fastening; and, said high-voltage circuit is closed via said line segment to said reference potential.

3. The ignition circuit of claim 1, wherein:

the combustion engine includes a fastening configured to fix said sensor on the combustion engine;

said sensor has a voltage connection connected to said reference potential via said fastening;

said sensor circuit is closed to said reference potential via said ignition module and said line segment.

4. The ignition circuit of claim 1, wherein said line segment is a flexible cable.

5. The ignition circuit of claim 1, wherein the combustion engine has a crankcase and said sensor is fixed on said crankcase.

6. The ignition circuit of claim 1, wherein said sensor is a first sensor configured to output a first sensor signal, said ignition module further comprising:

a second sensor configured to be supplied with voltage via said sensor circuit and to output a second sensor signal; and, said control unit being configured to perform an evaluation of said first and said second sensor signals and to intervene in the ignition in dependence on said evaluation.

7. The ignition circuit of claim 6, wherein:

said control unit is configured to switch off the ignition when said first and said second output signals are the same.

8. The ignition circuit of claim 6, wherein:

said control unit is configured to switch off the ignition when said first and said second output signals are the same maximum signal.

9. The ignition circuit of claim 1, wherein said sensor has a voltage connection, said ignition circuit further comprising:

a reverse biased diode;

said voltage connection of said sensor being connected to said reference potential via said reverse biased diode.

10. The ignition circuit of claim 9, further comprising:

a suppressor diode; and, said high-voltage circuit being connected to said reference potential via said suppressor diode and said voltage connection of said sensor.

11. The ignition circuit of claim 10, wherein said suppressor diode is arranged in said ignition module.

12. The ignition circuit of claim 1, wherein said sensor has a voltage connection, said ignition circuit further comprising:

a freewheel diode; and, said voltage connection of said sensor being connected to said reference potential via said freewheel diode.

13. The ignition circuit of claim 1, wherein said reference potential source is the combustion engine.

14. The ignition circuit of claim 1, wherein the combustion engine has a crankcase and said reference potential source is the crankcase.

15. The ignition circuit of claim 1, wherein the combustion engine is a combustion engine of a handheld work apparatus.

16. An ignition circuit for a combustion engine having a combustion chamber, the ignition circuit comprising:

a spark plug arranged in said combustion chamber;

an ignition coil configured to generate a high voltage for triggering an ignition spark at said spark plug;

a control unit configured to control said ignition coil;

said control unit and said ignition coil being consolidated in a common component as an ignition module;

a generator driven by said combustion engine;

said ignition module being connected to said generator;

said spark plug being disposed outside of said ignition module;

said spark plug and said ignition coil, which is disposed in said ignition module, conjointly forming a high-voltage circuit;

a reference potential source defining a reference potential outside of said ignition module;

said high-voltage circuit including a line segment connecting said ignition module to said reference potential;

a first sensor configured to detect operating parameters of the combustion engine, to transmit an output signal to said ignition module, and to output a first sensor signal;

said first sensor being electrically connected to said ignition module;

an electric sensor circuit providing a supply voltage to said first sensor;

said electric sensor circuit being connected between said ignition module and said reference potential;

said electric sensor circuit being connected via said line segment to said reference potential source;

a second sensor configured to be supplied with voltage via said electric sensor circuit and to output a second sensor signal;

said control unit being configured to perform an evaluation of said first and said second sensor signals and to intervene in the ignition in dependence on said evaluation;

said control unit being configured to switch off the ignition when said first and said second output signals are the same;

said high-voltage circuit being connected via said line segment to said reference potential so as to permit both said electric sensor circuit and said high-voltage circuit to be connected via said line segment to said reference potential;

said line segment being a cable;

said combustion engine defining a vibration exciting first unit;

a second unit for accommodating said ignition module therein;

said first and second units being vibration decoupled from each other and conjointly defining a vibration gap therebetween; and, said cable being arranged so as to bridge said vibration gap between said first and second units.

* * * * *